US005625986A

United States Patent [19]

Mansfield et al.

[11] Patent Number: 5,625,986

[45] Date of Patent: May 6, 1997

[54] SKELETAL REINFORCING MANUFACTURE

[76] Inventors: Mike Mansfield, 8023 Fallbrook, West Hills, Calif. 91304; Dan Knechtli, 32320 Crown Valley Rd., Acton, Calif. 93510-1927

[21] Appl. No.: 305,151

[22] Filed: Sep. 13, 1994

[51] Int. Cl.[6] ..... E04F 13/04

[52] U.S. Cl. ..... 52/255; 52/256; 52/344; 52/351; 52/364; 52/367

[58] Field of Search ..... 52/255, 256, 257, 52/254, 85, 367, 364, 376, 344, 352, 351

[56] References Cited

U.S. PATENT DOCUMENTS

| | | | |
|---|---|---|---|
| 658,386 | 9/1900 | Mitchell | 52/257 |
| 1,030,044 | 6/1912 | Wittbecker | 52/255 |
| 1,097,935 | 5/1914 | Pride | 52/255 |
| 1,161,764 | 11/1915 | Doner | 52/254 X |
| 1,419,232 | 6/1922 | Curtis | 52/255 |
| 1,608,475 | 11/1926 | Dean | 52/255 |
| 2,005,572 | 6/1935 | Vass | 52/85 |
| 2,012,203 | 8/1935 | Peterson | 52/255 |
| 2,272,162 | 2/1942 | Lackey | 52/367 X |
| 2,904,856 | 9/1959 | Robinson | 52/255 |
| 3,015,194 | 1/1962 | Clark | 52/344 X |
| 3,175,330 | 3/1965 | Holsman | 52/255 |
| 3,255,561 | 6/1966 | Cable | 52/255 |
| 3,333,379 | 8/1967 | Harris | 52/364 |
| 3,398,494 | 8/1968 | Larson | 52/371 |
| 3,412,512 | 11/1968 | Hollister | 52/256 X |
| 4,391,074 | 7/1983 | Holsman | 52/367 |
| 4,722,153 | 2/1988 | Hardy | 52/254 X |
| 5,138,810 | 8/1992 | Kartler | 52/254 |
| 5,313,755 | 5/1994 | Koenig, Jr. | 52/255 |
| 5,423,154 | 6/1995 | Maylon et al. | 52/364 X |

*Primary Examiner*—Carl D. Friedman
*Assistant Examiner*—Laura A. Saladino
*Attorney, Agent, or Firm*—Koppel & Jacobs

[57] ABSTRACT

A building material manufacture (20, 21, 22, 64, 70, 81) forming an openway (23, 24) in a building (26) and to which wet cement or stucco trim or the like (40) is applied. One embodiment (20) includes base (28) and side (29) segments having staggered slots (31) and beads (30*b*) coextensive in length thereto for determining the depth of plaster or stucco to be applied, and with mounting flanges (35,36). Another embodiment includes a tiered arrangement (45) of base/side segments and mounting flanges. Another embodiment is fabricated out of a skeletal configuration (51) of a reticulated foraminous sheet of metal connected to a pair of spaced flanged members (48). Another embodiment (64) is formed of wires, longitudinally and transversely oriented to each other, and including flange-like elements for connecting it to a building formation for an openway therein. And an embodiment (70) fabricated out of a single sheet of expanded metal, and an embodiment (81) that includes solid inverted V-shaped lengths (84) of elements integrally joined to lengths (82) of strands of interstices (83), both embodiments including mounting flanges. A backing for supporting applied plaster or stucco accompanies each embodiment in actual application to an openway.

24 Claims, 4 Drawing Sheets

FIG.8
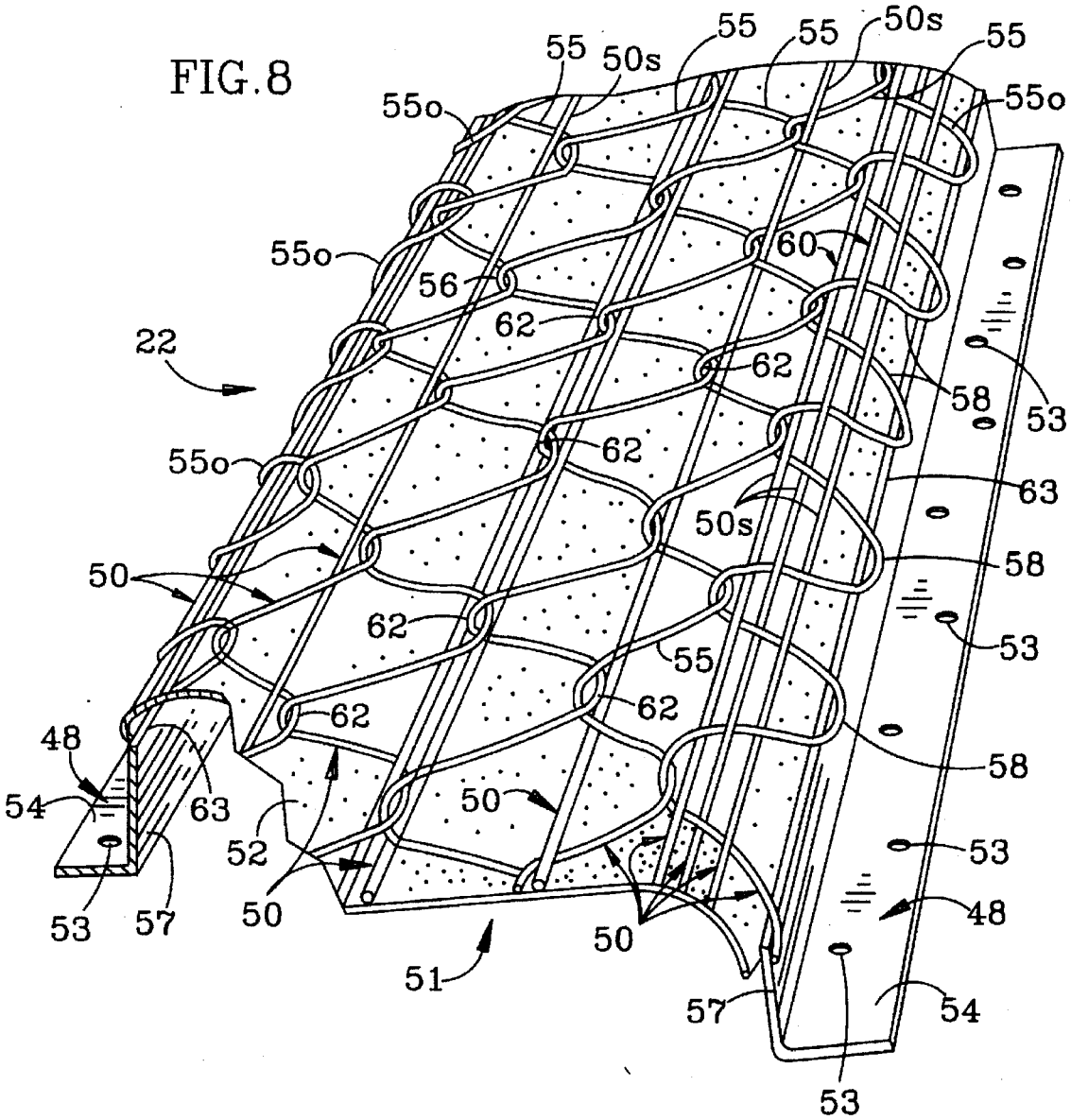
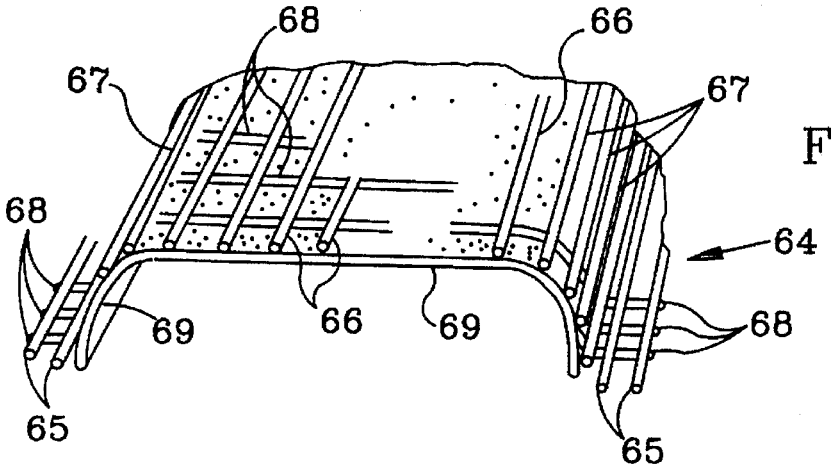
FIG.9

70
71
77
11
78
76
75
76
75
74
80
79
72
73
74
11

77
78
77
76
80
76
70
71
74
74
75
75
97
98
98
97

84
84
84
1
81
88
84
85
85
82
82
86
84
83
13
88
87
89
88
87
88

84
84
84
83
83
84
81
83
83
87
89
86
85
87
85

SKELETAL REINFORCING MANUFACTURE

TECHNICAL FIELD

This invention relates to building materials for structures, and particularly is directed to manufactures that reinforce plaster and the like mounted on backing and that provide a skeletal configuration for the finished appearance of plaster applied to the manufactures that are mounted to framing for openways, such as doorways, window ways, entryways, archways, and the like.

PROBLEMS IN THE BUILDING INDUSTRY

In conventional practice in the trade, a foundation of plaster, and to which a trimmed finish, usually known as stucco, is applied, is mounted to framing or body formations that form openings constituting doorways, window ways, etc., in the construction of buildings such as houses, apartments, commercial buildings and the like. A wooden base or framing is prepared and made for each installation, and to which conventional lath that comprises simple wire mesh is mounted, after which plaster/stucco layer(s) would be applied. Much labor and skill is required to finish off the lath and plaster/stucco applied thereto, however, such efforts in and of themselves do not reinforce the plaster/stucco applied to the lath on the rear of which backing for the plaster is mounted. Also, the depth of the layer or layers of plaster complicates the matter for there has been no positive way by which a proper depth of layer or layers could be determined to be mounted to the lath, and the depth itself did not carry any means to reinforce the plaster. What would occur would be the plastered wall about the opening itself cracking, its appearance showing it, with much of the cause being due to the wood, to which the lath and plaster is mounted, warping.

A corollary problem is the difficulty in determining a desired full depth for the layer or layers of plaster and stucco that are to be applied to the lath and wire mesh associated with it, about such openings.

This invention solves these vexing problems of cracking and non-reinforcing of depths of plaster existing in the building trade.

PRIOR ART

Examples of conventional or customary types of construction assemblies and manufactures used in the building trades are found in the disclosures of U.S. Pat. Nos. 787,207; 1,793,634; 1,798,381; 1,885,343; 2,045,482; 2,056,288; 2,669,114; and in British Patent No. 658,300 published Oct. 3, 1951.

SUMMARY OF THE INVENTION

The invention, in all embodiments, is directed to depth measuring elements mounted on a generally U-shaped metal member, reticulated foraminous or otherwise, to which layers of plaster are to be applied. In one embodiment, the U-shaped member is fabricated from a one-piece or single length of sheet metal construction and includes slots and holes in its base and side segments for securing plaster and stucco application to it. A depth measuring element joins together its slotted base and each of its side segments, the depth being such as to produce a positive way of reinforcing applied plaster to the construction. Outwardly extending flanges on the distal ends of the opposing side segments attach the member to wooden framing or the like. In another embodiment, different sized sheet metal members are mounted one to another to form tiered arrangements and to which the plaster can be applied. Spacer blocks may be provided to maintain the members' configurations during their installations to openways and during applications of plaster and other wet cement.

Another embodiment of the invention, for use in a one coat stucco application, is embraced in a foraminous reticulated metal assembly. In a given length of the assembly, a foraminous reticulation of strands of wires, forming a wire mesh arrangement, is securely mounted to a pair of spaced mounting means such as solid flanges extending along such length and below such reticulation. Another embodiment of the invention utilizes longitudinally-oriented and traversely-oriented wires, with the transversely oriented wires bent outwardly along each longitudinal edge of the member to form the attaching legs for the member to a wooden framing outlining the openway. The foraminous reticulation of wires is rigidly configured above or out of the plane between the spaced flanges, or above the attaching legs, of the member, to form a desired skeletal configuration for a particular doorway or the like. The foraminous reticulation of wires is fabricated in terms of looped and straight and grouped strands of wires interlocked or interconnected with one another as they extend the length of the manufacture.

A basic reduction of the inventive concept is found in another embodiment comprising a fabricated member formed out of the well known expanded metal manufacture and which includes depth measuring means for the plaster and flanging within the fabricated member itself, along the length of the member, for mounting to a building's framing.

Another embodiment of the invention is found in expanded metal that is fabricated in a differently arranged manner than the basic reduction embodiment.

In any embodiment of the invention, for curved appearances in the trimmed finishes of plaster adhering to this manufacture, portions of the elements, such as flanges, segments, and wires are cut or snipped out, or scored and cut, so that the manufacture can be curved or otherwise disposed accordingly as desired about the opening to the framing. And suitable backing material for wet cement and the like is reinforced by the skeletal manufactures of this invention.

An object of the invention is to provide novel manufactures that form specific skeletal configurations about a building's opening and which reflect its final appearance, while also reinforcing plaster or the like applied to the manufacture.

Another object of this invention is to provide a novel configuration of a foraminous reticulated sheet of metal or wires as a skeleton for an openway in a building construction and which also provides reinforcement for applied plaster or the like.

Still another object of the invention is to provide a building manufacture having a specific configuration by which the depth of the plaster or stucco to be applied is readily determined by the configuration itself.

A further object of this invention is to provide a particular arrangement of an expanded metal fabrication that facilitates the installation of plaster and the like about a building's openway. A further object of this invention is to eliminate the cracking of cured plaster or stucco in a wall trimmed upon the manufacture of this invention applied to a building's openway, thereby increasing the life of the finished stucco wall.

A further object of the invention is to fabricate building materials, in forms of specific skeletal configurations, from a single sheet of metal or other suitable material.

These and other objects and advantages will become more fully apparent by a full and complete reading of the following description, the appended claims thereto, and the accompanying drawing comprising four (4) sheets of thirteen (13) FIGURES.

BRIEF DESCRIPTION OF THE DRAWING

FIG. 8 is a fragmentary perspective view of another embodiment of the invention.

FIG. 9 is a fragmentary view of still another embodiment of the invention.

BEST MODE OF CARRYING OUT THE INVENTION

Figure 1:
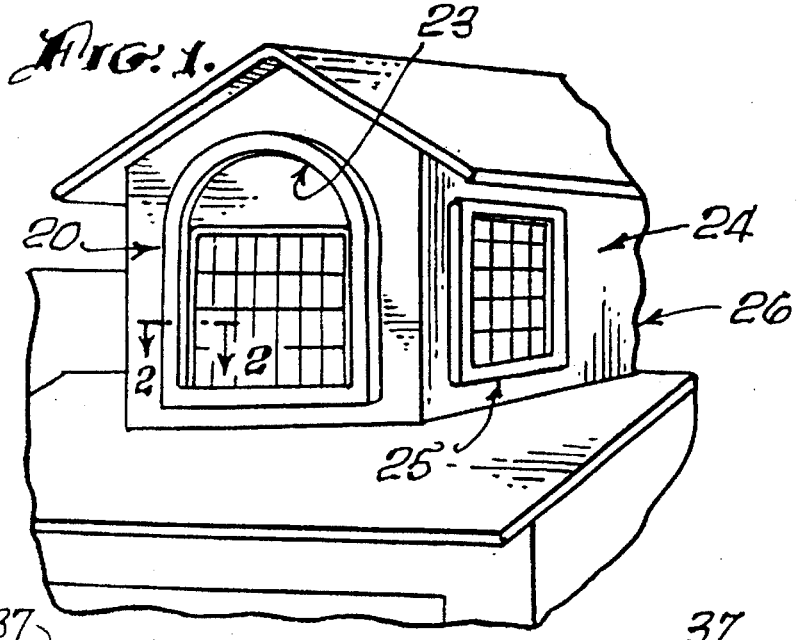
FIG. 1 is a perspective view of arched and rectangular window ways in a building in which the manufactures of the invention are installed.

Referring to the drawing wherein reference characters therein correspond to like numerals hereinafter, FIG. 1 illustrates finish appearances resulting from the use of any one of the manufactures 20, 21, 22, 64, 70, and 81, FIGS. 2–13, embodiments of the invention, and which are incorporated into an arched window way 23 of a window setting in one wall 24, and into a rectangular window way 25 of a second window setting in an adjacent wall of the same (or another) building 26.

FIGS. 2–5 illustrate one embodiment or manufacture 20, comprising a generally U-shaped member 27 in cross-sectional appearance. Member 27, FIG. 2, extends a reasonable length in its fabricated shape or configuration, for example, a length of ten (10) feet (not shown). The shaped member 27 includes a bottom or base segment 28 integrally formed with a pair of spaced side segments 29 out of a single piece of sheet metal, the segments 28 and opposing segments 29 connected or joined together by corresponding depth measuring members 30 integrally formed between and angularly related to the base and side segments 28, 29, respectively. The base and side segments 28, 29 include along their respective lengths staggered transverse rows of pluralities of holes or slots 31, FIGS. 3, 4, disposed in their respective widths, and columns of circular holes 32 formed in their respective marginal portions 33, 34 that define the limits of the respective segments widths. Outwardly extending flanges 35, 36 are integrally formed at the ends of and to their corresponding side segments 29 to laterally terminate member 27 and to provide means by which manufacture 20 is mounted to framing.

Each of the depth measuring members 30 comprises a bead **30*b* formed by crimping of the sheet metal, and is preferably co-extensive with the length of the U-shaped members 27. Bead 30*b* extends generally obliquely from the planes of the base and side segments 28, 29, so as to provide corresponding cavities 38, FIG. 2, that communicate with their respective base and side segments. Each cavity 38 is disposed between each of the corresponding planes of the base and side segments 28, 29 and another plane (perpendicular to the drawing sheet) lying parallel to the corresponding plane of the segments 28, 29, respectively, and which latter plane intersects the extreme points or loci of points 39 on the corresponding depth measuring member 30. Each cavity 38 provides for the application of a plurality of layers of plaster 40, FIG. 2, on the members 28, 29, while their extreme points 39 determine the depth of the final layer of plaster, such as a layer of stucco or other wet cement, that is to be applied. One or more spacer blocks 41, of foam or plastic material, are spacedly mounted, when needed or desired, within the hollow 42 formed behind the segments 28, 29** and abut such segments.

Figure 5:
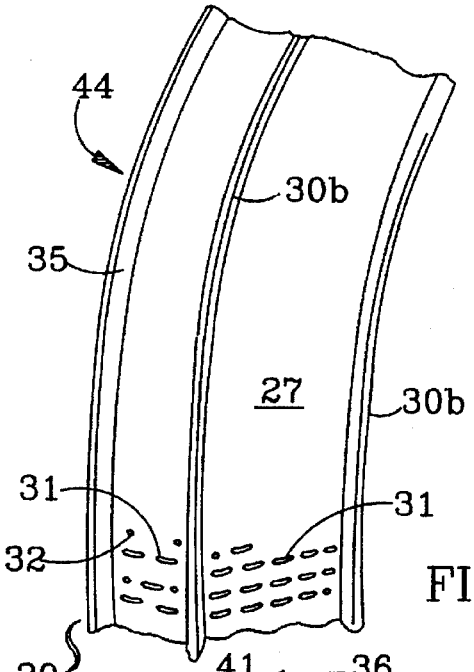
FIG. 5 is a fragmentary perspective view of the FIGS. 2–4 embodiment of the invention, illustrating an assembly thereof at a corner connection and a curved arrangement of the embodiment extending from such corner connection.

FIG. 5 illustrates a corner connection for two (2) members 27 of the same size. A diagonal cut 43 is suitably made by known sheet metal techniques in the base segment 28 of a pair of members 27, its side segments 29 being squared off in their cutting, in order to join together such members in a customary manner. A portion of the upright-appearing member 27 is shown to be curved along its length at 44. Whatever curvature in an open way is desired, state-of-the-art cutting techniques, which provide for bending or snipping of the member 27, in its elements 28, 29, 30, to the extent desired, produces the curved appearance viewed at 44 in FIG. 5.

Figure 6:
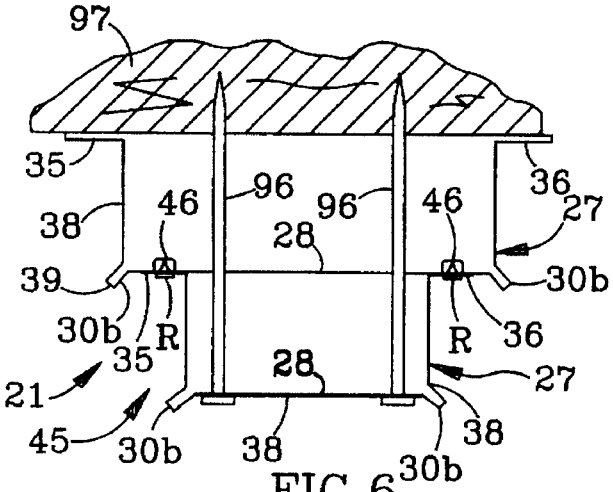
FIG. 6 is a cross-sectional view of another embodiment of the invention, showing a tiered arrangement by means of different sizes of the manufacture.

FIG. 6 illustrates an embodiment of the inventive concept in a manufacture 21 comprising a tiered arrangement 45 of members 27, mounted one upon the next by reason of the mounted member being of a smaller size. The tiered arrangement 45 need not require fasteners as it can be formed or shaped from a single-pieced sheet metal member or from other suitable material, one of which being described in reference to the FIGS. 10/11 embodiment. However, rivets R or other suitable fasteners can be utilized, FIG. 6, to attach the flanges 35, 36 on a separate or independent smaller-sized member 27 to the bottom or base segment 28 of the next larger-sized member 27, utilizing spaced holes 46, FIG. 6, provided in the flanges 35, 36 of the smaller-sized member and which mate with corresponding circular holes 32 in the marginal portions 33, 34 of the base segment 28 in the larger-sized member 27.

Figure 7:
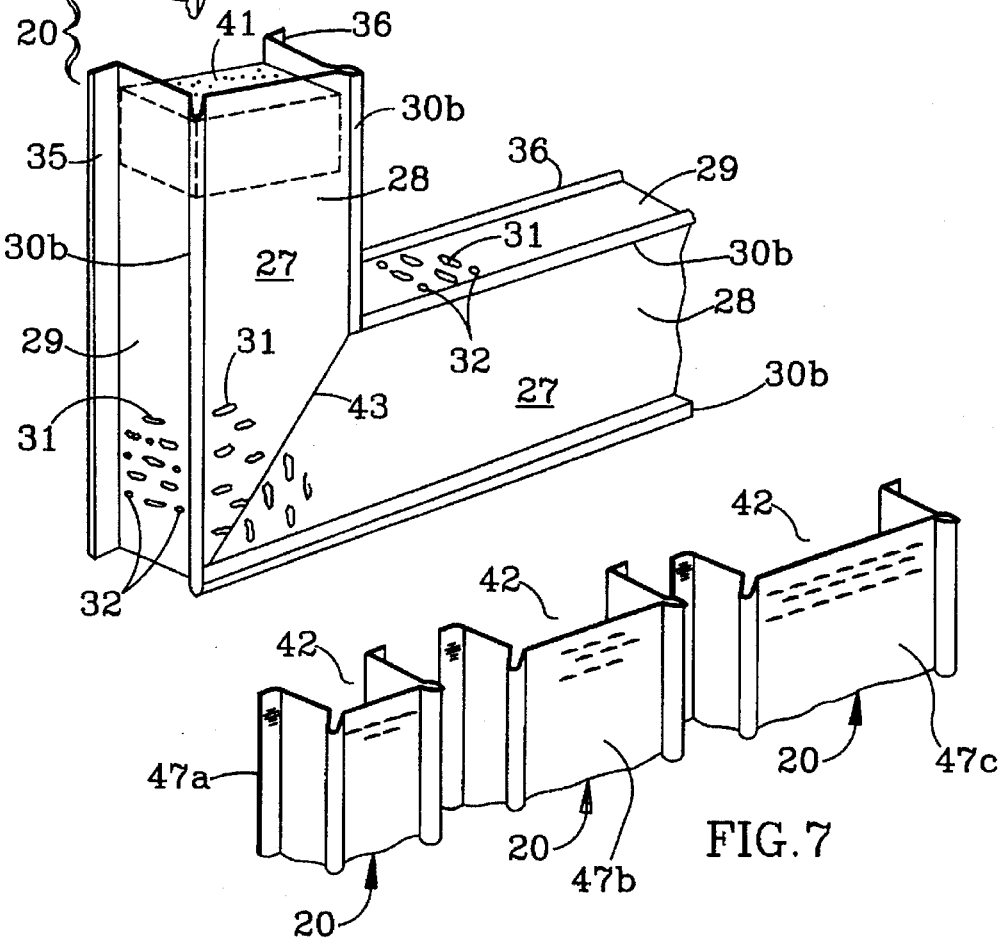
FIG. 7 illustrates in fragmentary manner different sizes of the FIG. 6 embodiment.
Figure 10:
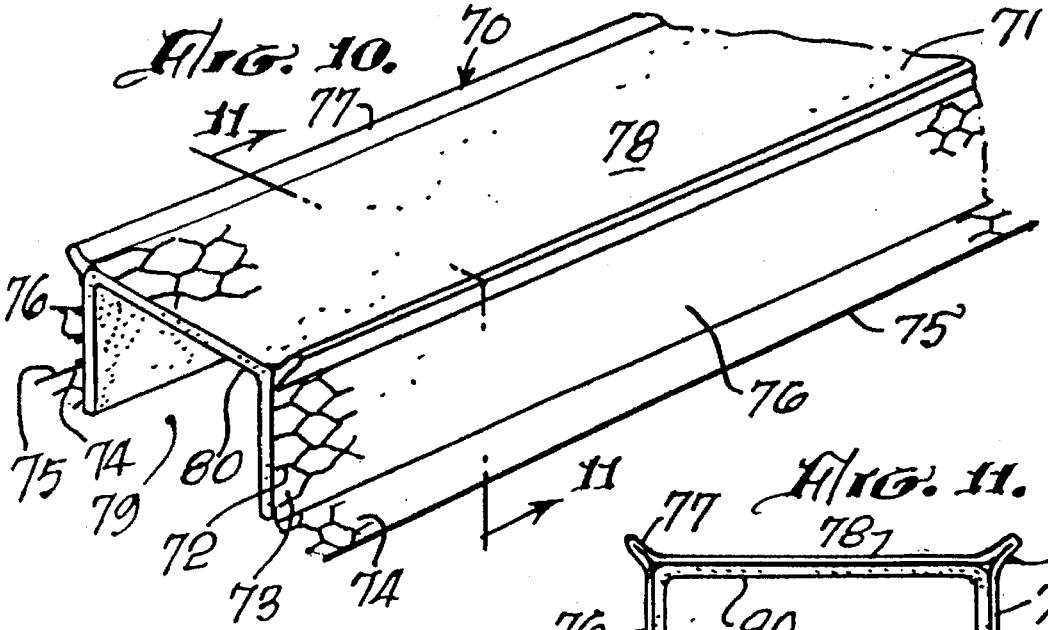
FIG. 10 is a perspective view of the basic reduction embodiment of the invention.
Figure 11:
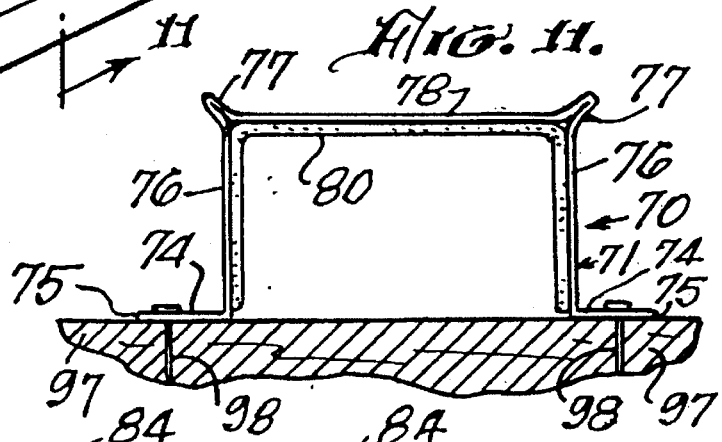
FIG. 11 is a view taken on line 11—11 of FIG. 10.

FIG. 7 illustrates different sizes **47*a*, 47*b*, 47*c* of the subject matter 20 of the invention that can be put to the embodiment of the invention in the tiered arrangement of the FIG. 6 embodiment 21, two or more, as it may be desired. The illustration of FIG. 7, it should be understood, as indicated above, does not limit the FIG. 6 embodiment to utilizing only different sizes of member 27 to achieve a tiered arrangement, as a single-pieced metallic sheet of material, meshed or metal, with holes slots or slots in it, produces the same tiered arrangement as the FIG. 6** arrangement with its rivets R.

In the FIG. 8 embodiment, the manufacture 22 comprises a pair of spaced metal flanged members 48, between the span of which a foraminous reticulation of solid wires 50 forms a skeletal configuration. With the members 48, this reticulation defines the desires configuration 51 for an openway in which the length of the manufacture 21 is to be employed. A backing 52, the nature of which being suitable trade or construction paper, is mounted behind the foraminous reticulation of wires 50 that reinforces the backing 52 in the application of a single coat of wet plaster or stucco layer. The manufacture 22 is made in terms of a given length, an example of which being ten (10) feet (not shown). Each flanged member 48 is lightweight, and includes a plurality of off-line or staggered holes 53 in a first leg 54 for attaching the manufacture 22 to framing, stud, or the like, already in place on the building 26 to which the skeletal manufacture 22 is to be mounted. Columns of weave wires 55 span the distance between the flanged members 48, each weave wire of which including alternately-directed loops along its length. Extreme points 56 on each loop in a column of weave wire 55 and which is directed in one way across such span meets and is attached to an extreme point 56 on an oppositely directed aligned loop in an adjacent column of a weave wire, including such attachment to weave wires forming the two columns **55*o* outermost in the span. Alternately-directed loops in each of the two columns 55*o* of weave wires are attached, such as by spot welding, to the second leg 54 of their corresponding flanged member 48, as at 58. The columns 55*o* of weave wires 56 are fashioned either in flat or rolling manner along their lengths. The flat manner provides for a square-cut skeleton manufacture, and the rolling manner, as illustrated in FIG. 8, provides for a curving roundness from each of the flanged members 48 in the skeleton manufacture towards its center. It should be understood that as the width of the desired openway determines the width or span of each manufacture 22, that the total number of columns, of both the columns 55*o* and those disposed inwardly thereof (the columns of weave wires 55**), will vary.

One or more straight wires **50*s*, either grouped together as a plurality of closely-positioned straight wires, as shown at 60, or separately situated by themselves, extend the length of the manufacture 22 and are attached, as by spot welding, to the loops of the weave wires 55, and to the loops of the outermost columns 55*o* of weave wires, at points where they cross one another, as at 62** as an example.

The result of this fabrication of assembly of wires is a foraminous reticulated metallic manufacture 22, with minimal metallic substance or mass upon which non-cured [for example, in a wet condition] plaster or stucco or other surfacing cement can be applied in a conventional manner.

The foraminous reticulation of the sheet of wires 50 is disposed substantially above or outside a plane extending between the two edges 63 of the upright legs 57 of the flanged members 48, and thereby provides for the skeletizing of a configuration or pattern that reinforces the ultimate body formation of plaster or stucco or other surfacing cement applied to the backing 52. By means of spot welding, or by dies and the application of a hydraulic press thereon, these points of attaching of the wires one to another is accomplished. Although the wires 50 forming the looped and straight wires are in and of themselves flexible or bendable, this attaching of the wires one to another provides the necessary rigidity to the skeletal configuration of the manufacture 22 for operational purposes.

The embodiment illustrated in FIG. 9 discloses a manufacture 64 comprising longitudinally oriented sets of wires and a transversely oriented set of wires, arranged to provide a skeletal reinforcing configuration or medium. Two sets 65 of a plurality of aligned and spaced straight wires, spaced from each other in each such set, extend generally co-extensive with the length [say, ten (10) feet] of the manufacture 64. A second set 66 of a plurality of aligned spaced wires, generally parallel to the sets of wires 65, are disposed in a plane distant from that of the sets of wires 65. Each of two aligned (third) sets of wires 67 is disposed correspondingly between the sets of wires 65, 66, separating them but nevertheless extending in generally parallel fashion to the sets of wires 65, 66. These (third) sets of wires 67 are disposed in corresponding oblique or perpendicular planes that pass through the planes of the sets of wires 65 and 66. A transversely-oriented (fourth) set of wires 68, spaced from one another, extend transversely along the length of manufacture 64, and are attached, such as by spot welding, to the sets of wires 65, 66, and 67, with the sets of wires 65, 66, and 67 atop the sets of wires 68, although a weaving of wires, between those in the set of wires 68 and those in the set of wires 65, 66, and 67, also is feasible. The transversely-oriented set of wires 68 are configured, i.e., bent at distal locations in their lengths, adjacent to their ends, such configuring or bending generally paralleling the planes in which the sets of wires 67 are located or disposed, and continue in their lengths towards their distal ends, thereby forming, with the set of wires 65 flange-like elements that function in the same manner as flanged members 48 in the FIG. 8 embodiment, thereby constituting the means to mount manufacture 64 to a framing, studs, or the like, while nevertheless cooperating with the wires with which they are attached to retain the desired skeletal configuration required as the reinforcing medium for a backing to which wet cement or stucco is to be applied. An oil-treated paper or backing 69 or the like is mounted to the underside of the arrangement of the sets of wires 65, 66, 67, and 68, the latter reinforcing the backing 69 as wet plaster is applied over the outer sets of wires 65, 66, and 67, as is the case with all of the manufactures of this invention, i.e., these lath manufactures functioning as reinforcing mediums for the applied plaster.

The FIGS. 10–13 embodiments utilize the well known state-of-the-art "expanded" metal fabrication. The manufacture 70, FIGS. 10/11, comprises a configured member 71 formed from a suitably lightweight expanded metal fabrication sheet, and of a suitable length, such as ten (10) feet for example (not shown), in which the entire member 71 is formed of integrally joined strands 72 having interstices 73 throughout its dimensions and areal boundaries, the strands 72 and their interstices 73 configured along the length of the member 71 into a shape that parallels the FIGS. 1–5 embodiment. The strands 72 and their interstices 73 form mounting flanges 74 at the laterally disposed edges 75 of the member 71. Vertically-oriented walls or side segments 76 connect the flanges 74 to corresponding beads 77 that measure the depth of the plaster to be applied. A base or bottom segment 78 connects together the pair of beads 76. A filler block, like that of block 41, when needed or desired, is utilized in the application of the member 71 to an openway body formation, and is placed within the cavity 79 of the member 71 formed by the walls 76 and the base segment 77. A backing 80 is suitably mounted in fixed position to the interior of the lengths 72 of strands throughout the boundaries of the manufacture 70.

Figure 12:
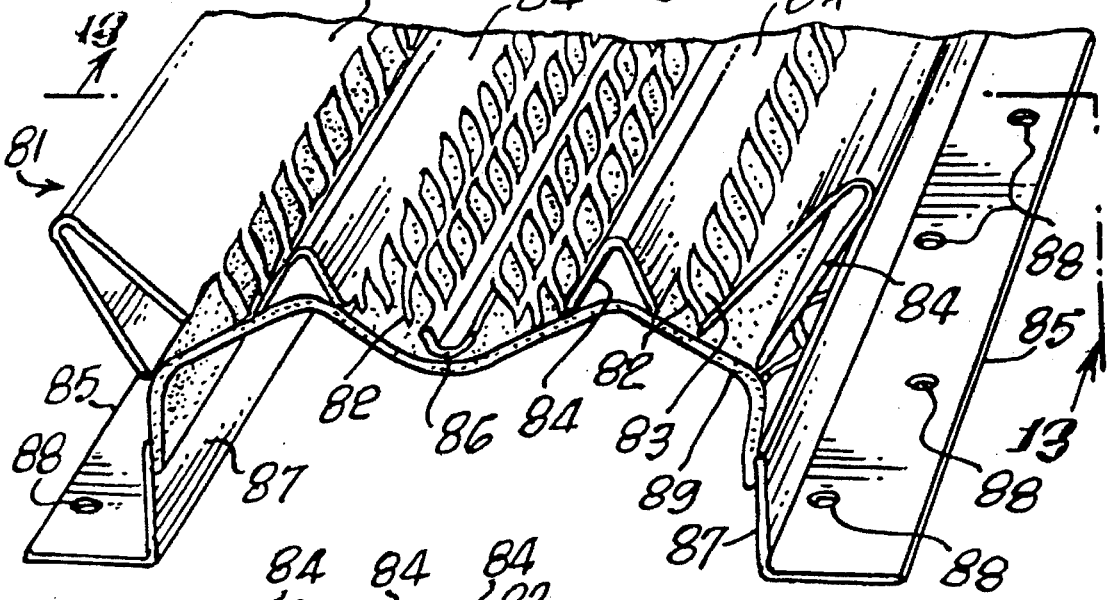
FIG. 12 is fragmentary perspective view of another embodiment of the invention.
Figure 13:
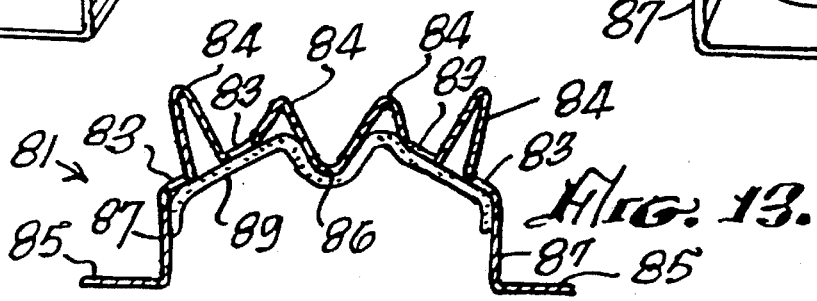
FIG. 13 is a view taken on line 13—13 of FIG. 12.

The manufacture 81, FIGS. 12/13, also is configured from an expanded metal fabrication sheet, to include lengths 82 of strands interwoven with contiguously positioned columns or series of strands each column of which having interstices 83. Furthermore, manufacture 81 includes longitudinally oriented inverted V-shaped lengths 84 of solid segments or portions retained and contained within the expanded sheet fabrication out of which manufacture 81 is made, and alternate in column-like fashion with the lengths 82 of strands. Solid flanged members 85 are retained and contained within the expanded sheet fabrication out of which manufacture 81 is made. Flanged members 85 are integrally joined to the two (2) outermost corresponding lengths 82 of the strands. A column or series of inverted V-shaped lengths 84 of the solid segments or portions integrally join with the outermost lengths 82 of strands, on the one hand, and on the other, integrally join in alternating manner with series or columns of lengths 82 of strands with their interstices 83, extending across the span between the spaced flanges 85. A centrally disposed upright V-shaped length 86 of solid section or portion of the sheet fabrication out of which manufacture 81 is made joins with immediately adjacent lengths 82 of strands in their series or columns. It should be understood that as many alternating lengths 82 of strands and lengths 84 of solid segments or portions may be utilized across the span or lateral width of the manufacture 81 as desired, for installing in an openway the formation of which itself includes a width. The corresponding legs 87 of the flanged members 85 and which terminate manufacture 81 are provided with staggered holes 88 for securing the manufacture 81 to framing or studs in the same manner as done in the manufacture 22 of FIG. 8. A ready-made depth measuring means for manufacture 81 is seen in FIGS. 12/13, by observing the depth of the lengths 84 of the inverted V-shaped solid segments or portions, this depth being adjustable in the making of manufacture 81 by the manner and extent of expanding the outermost lengths 82 of strands and by the depth of the lengths 84 of the inverted V-shaped segments. Backing 89 is suitably fixed, across the span of the manufacture 81, to and under the lengths 82 of strands of the manufacture 81 and which reinforces the backing 89 during application of wet cement or plaster to the manufacture 81.

Figure 2:
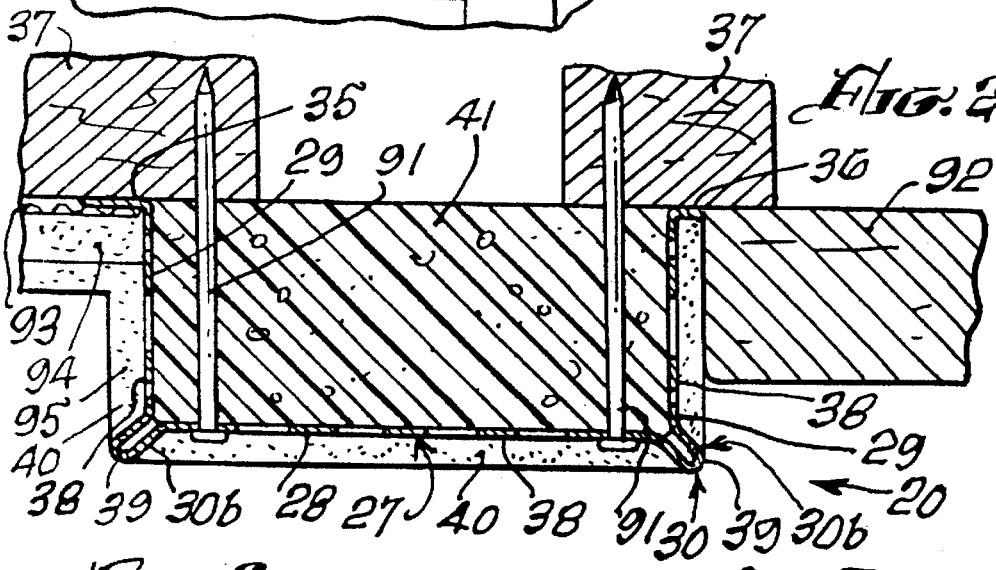
FIG. 2 is a sectional view of an installed embodiment of the invention, taken on line 2—2 of FIG. 1.
Figure 3:
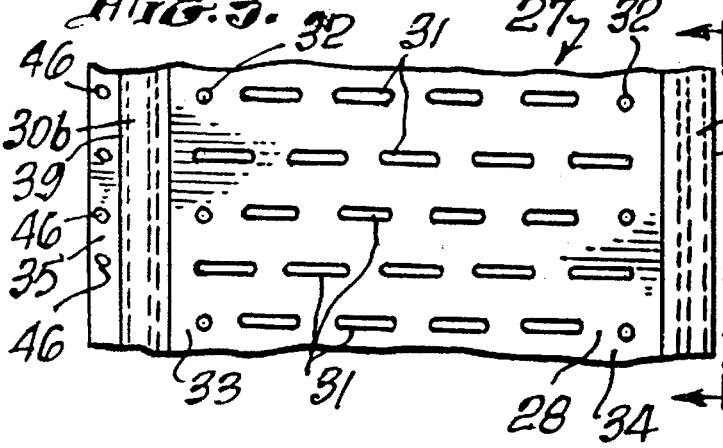
FIG. 3 is a fragmentary plan or bottom view of the embodiment illustrated in FIG. 2, modified by the lack of showing of the applied plaster in FIG. 2.
Figure 4:
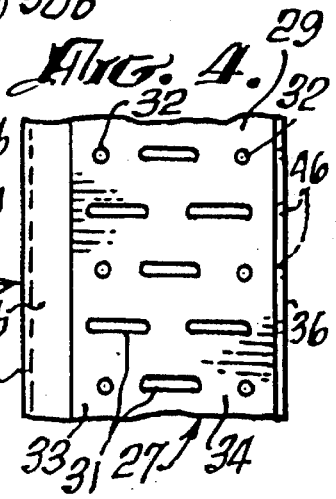
FIG. 4 is a fragmentary view taken on line 4—4 of FIG. 3.

In use, referencing the FIG. 2 embodiment, one or more spacer blocks 41, if needed or desired, are inserted along the length of the manufacture 20 and within the spacing between its side segments 29. Nails 91 are driven past the circular holes 32 in the bottom segment 28 (only partially into the blocks 41 when used. i.e., not past the plane of their two flanges 35, 36). Manufacture 20 is mounted to the framing or studs 37, and where applicable contiguous to a window frame 92, held in position, and then the nails 91 driven home, as shown in FIG. 2. Conventional paper and wire mesh 93 is applied, such as by stapling (not shown), to the framing 37 and studs (not shown) where applicable. Thereafter, a first coat 94 is applied in the area of the flanges 35, 36, and a scratch coat of plaster 95 (not delineated IN FIG. 2) is applied to the manufacture. Thereafter, a finish coat 95 of plaster or stucco is applied to manufacture 20, trimmed and let cure, usually along with the plastering steps taken elsewhere on the building's framing as well. The depth of the total coating or coatings has been determined by the depth gauging means 30.

The FIG. 6 embodiment is made operative in the same manner as that of the FIG. 2 embodiment, with nails 96 securing manufacture 22 to framing 97.

Referencing the FIG. 8 embodiment, the manufacture is attached to framing or studs with nails (not shown), the nails being driven home through the staggered holes 53 in flange legs 54. In the FIG. 9 embodiment, nails or staples (not shown) are driven in to framing or studs at locations juxtaposing the wires in the sets 65 and 68. In the FIG. 10/11 embodiment, nails, staples 98 or the like attach the strands in lengths 82 disposed in the flanged members 75 to the framing 97, FIG. 11, where no filler block 41 is utilized. In the FIG. 12/13 embodiment, staggered holes 88 are utilized for securing the manufacture 81 to framing (not shown) by suitable nails (not shown. The usual and known applications of plaster in its various layers and stucco, and trimming thereof follow, utilizing the respective beads, where applicable, in each manufacture as the means to determine the depth of application thereof.

The fabrication of the two (2) FIGS. 1–7 embodiments is provided by braking, bending, crimping and/or other sheet metal equipment by which the slots, holes, and beading is accomplished. The embodiments of FIGS. 8 and 9 are fabricated through spot welding applications and techniques to rods and wires, and even by use of die and hydraulic press operations, and by which they are interlocked with one another at their crossing points, and with the flanged member 48 of the FIG. 8 embodiment. The corresponding backings are fixedly mounted in place after these fabrications are completed. The FIGS. 10/11 and 12/13 embodiments are fabricated by means of braking, bending and expanded metal equipment, using state-of-the-art techniques in each application.

It is apparent that metal and conventional backing paper form the bases for the materials used in the practice of the invention, i.e., in the fabrication of the aforescribed embodiments. More importantly, however, it is to be noted that in each of the embodiments, in the application of plaster or wet cement to the backings, thereare initial points or planes or lines in the manufactures themselves from which a measurement of depth for plaster to be applied is made. In the FIGS. 1/5, 6/7 embodiments, it is the depth of the cavities 38 arising out of the configurations of and the positioning of the beads 39 to the manufactures 20, 21. The FIGS. 8 and 9 embodiments are special manufactures, wherein only one coating of plaster or stucco is applied, and in which depth measuring means are shown as being absent, however, depth measuring means are readily applicable to these two (2) embodiments as well as in the FIGS. 1/5, 6/7, 10/11, and 12/13 manufactures, by utilizing breaking, bending, and crimping equipment, along with spot welding equipment for attaching separate beads to the illustrated building material in these FIGURES, and techniques of welding associated therewith, to form beads of wire configured like the beads 39, 77 respectively illustrated in the FIGS. 2 and 10/11 embodiments.

In openways that include curved shapes or configurations for their final appearances, particular points at desired spatial intervals along the lengths of the metal elements in the corresponding manufactures are cut or snipped or bent to achieve the desired curving for the body formation forming the particular openway under consideration. The characteristics of the metal of the manufactures are not inflexible or so unyielding as to prevent by manual cutting and bending techniques to prevent such desired curving. For example, in the FIG. 1/5, 6/7 embodiments, portions of flanges 35, 36, of the depth measuring means 30, and of necessary portions of segments 28 and 29, are cut out or away so that a curvature in appearance, such as shown at 44 in FIG. 5, can be generated by turning such elements towards or away from one another to the extent desired. In the FIG. 8 embodiment, portions in the legs of the flanged members 48, along with the cutting of any (not all of them, of course) of the wires 50, accomplishes a desired curvature in the installation of this embodiment. Likewise, in the wires 65, 66, 67 and 68 of the FIG. 9 embodiment. Similarly, the same cutting, snipping, bending, and turning operation is readily applicable to the embodiments illustrated in FIGS. 10/11 and 12/13.

The invention is not to be limited or construed to the exact parts or elements or their arrangements shown in the accompanying drawing or described in this specification, as various changes and modifications in the details of construction may be resorted to without departing from the spirit or scope of the invention. For example, filler blocks shown in the cavities need not be used in each application. As already indicated, depth measuring means are also available for incorporation in the FIGS. 8 and 9 embodiments should it be desired to do so, and can be accomplished by crimping wires, to fashion beads, in the region of and along one or both outermost columns of weave wires 55*o*, either done integrally with the wires [the alternately directed loops being somewhat longer than illustrated in FIG. 8) or by crimping an independent mesh of wires to form a bead that then is suitably fastened, such as by spot welding, to the wires illustrated in FIGS. 8 and 9. Also, the tiered arrangement 45 can be incorporated, with the use of wires, as an integral part of or added to the FIGS. 8, 9, 10/11, 12/13 embodiments should it be desired, either being integrally formed therein or by separately formed tiers that are suitably fastened thereto by spot welding. The vertically-oriented walls 76 in the FIGS. 10/11 embodiment, as well as vertically-oriented walls in any embodiment of the invention, can be rounded or curved in a like or similar manner as illustrated in the FIG. 8 embodiment. Therefore, only insofar as the invention has particularly been pointed out in the accompanying claims is the invention to be limited or construed.

We claim:

1. A building material member for mounting on a flat surface of a building frame to define a skeletal configuration that when finished provides a raised trim, comprising:

segment means extending substantially the length of the material member, said segment means comprising a base segment and side segments mounted to said base segment in opposing relation to one another, said base and side segments each having a plurality of holes for adhering plaster thereto, mounting means on each of said side segments that extend laterally therefrom such that said mounting means are approximately parallel to and spaced apart from the base segment along the side segment mounting the material member to a flat surface of a building frame, and means for determining the initial point of measurement of the extent of the depth to which a plaster finish is able to be applied, mounted between said base segment and at least one of said side segments.

2. The material member of claim 1 wherein said determining means comprises a bead.

3. The material member of claim 1 wherein it is of a one-piece wire mesh construction.

4. The material member of claim 1 wherein said member is a one-piece construction formed from a sheet of expanded metal.

5. The material member of claim 1 wherein said base and side segments, said mounting means, and said determining means are formed from a single-piece of construction of sheet metal, said sheet metal in its base and side segments including the holes therein.

6. The material member of claim 1 wherein said base and side segments, said mounting means, and said determining means are formed of longitudinally oriented sets of wires and a transversely oriented set of wires, the wires in said set and sets attached together at points at which they cross one another, to provide a skeletal reinforcing configuration in said material member.

7. The material member of claim 6 wherein the longitudinally oriented sets of wires mount atop the transversely oriented set of wires.

8. The material member of claim 6 wherein the wires in the longitudinally oriented sets of wires and the wires in the transversely oriented set of wires weave with one another.

9. The material member of claim 1 wherein said base and side segments, said mounting means, and said determining means are formed of longitudinally oriented sets of wires and a plurality of alternately-directed wire loops; and the longitudinally oriented wires and wire loops are attached together at locations at which they cross one another, to provide a skeletal reinforcing configuration in said material member.

10. A building material member for mounting on a flat surface of a building frame to define a skeletal configuration that when finished provides a raised trim, said material member comprising segment means extending substantially the length of the material member, said segment means comprising a base segment and side segments mounted to said base segment, mounting means on each of said side segments for mounting the material member to a flat surface of a building frame, said side segments in opposing relation to one another and joining the base segment to said mounting means, and means for determining the initial point of measurement of the extent of the depth to which a plaster finish is able to be applied, mounted between said base segment and at least one of said side segments, said material member including a tiered arrangement of two or more sets of said segment means, mounting means and determining means.

11. In the material member of claim 10, said sets being integrally formed from a single-piece of construction material.

12. A trim member for mounting on a flat surface of a building frame to provide a skeletal configuration for a plaster finish, comprising:

a pair of lateral flanges that lie approximately in a common plane for connection to a flat surface of a building frame;

a pair of juxtaposed wire mesh side segments connected to the lateral flanges and extending away from their common plane in an approximately perpendicular direction;

a wire mesh base segment disposed between said side segments, said wire mesh side and base segments facilitating the adherence of plaster thereto; and a pair of beads connecting said side segments to opposing ends of said base segment, respectively, so that said base is approximately parallel to and spaced apart from the flanges' common plane to define a skeletal configuration, said beads determining a depth to which plaster is able to be applied over said side and base segments.

13. The trim member of claim 12, wherein said flanges and beads are wire mesh.

14. The trim member of claim 13, wherein said trim member is an integral wire mesh.

15. The trim member of claim 14, wherein said wire mesh trim member comprises:

longitudinally oriented sets of wires and a transversely oriented set of wires, the wires in said transversely oriented set and said longitudinally oriented sets being attached together at locations at which they cross one another, to provide a skeletal reinforcing configuration in said trim member.

16. The trim member of claim 14, wherein said wire mesh trim member comprises:

longitudinally oriented sets of wires and a plurality of alternately-directed wire loops, the longitudinally oriented wires and wire loops being attached together at locations at which they cross one another, to provide a skeletal reinforcing configuration in said trim member.

17. The trim member of claim 14, wherein said integral wire mesh has inner and outer surfaces, further comprising a paper backing on the inner surface of said integral wire mesh.

18. A trim member, for mounting on a flat surface of a building frame to provide a skeletal configuration for a plaster finish, comprising:

a pair of wire mesh flanges for connection to a flat surface of a building frame;

a pair of juxtaposed wire mesh side segments connected to the flanges and extending therefrom;

a wire mesh base segment having a tiered shape disposed between said side segments, said wire mesh side and base segments facilitating the adherence of plaster thereto; and a pair of wire mesh beads connecting said side segments to opposing ends of said base segment, respectively, so that said base is able to be spaced apart from the flat surface to define a skeletal configuration, said beads determining a depth to which plaster is able to be applied over said side and base segments, said flanges, side segments, base segment and beads being an integral wire mesh.

19. A trim member for mounting on a flat surface of a building frame to provide a skeletal configuration for a plaster finish, comprising:

a pair of lateral flanges that lie approximately in a common plane for connection to a flat surface of a building frame;

a pair of juxtaposed side segments connected to the lateral flanges and extending away from their common plane; and a base segment connected between distal ends of said side segments so that said base segment is approximately parallel to and spaced apart from the flanges' common plane to define a skeletal configuration, said flanges, side and base segments being integrally formed wire mesh for adhering plaster thereto.

20. The trim member of claim 19, further comprising:

a pair of beads between the respective side segments and said base segment for determining a depth to which plaster is able to be applied over said side and base segments.

21. The trim member of claim 19, wherein said side segments are approximately perpendicular with respect to the flanges' common plane.

22. A building frame having raised trim, comprising a building frame having a flat surface;

a pair of lateral flanges that are spaced apart and connected to the flat surface of the building frame;

a pair of juxtaposed side segments that are connected to the respective lateral flanges and extend approximately perpendicularly therefrom to form a pair of non-obtuse exterior angles;

a base segment that is disposed between said side segments, said side and base segments facilitating the adherence of plaster thereto;

a pair of beads connecting said side segments to opposing ends of said base segment, respectively, so that said base is spaced apart from the frame's flat surface to define a skeletal configuration, said beads determining a depth to which plaster is able to be applied over said side and base segments; and a plaster finish over the frame's flat surface and the skeletal configuration to provide a finished surface having a raised trim.

23. The building frame of claim 22, wherein said base segment is approximately parallel to the frame's flat surface.

24. The building frame of claim 22, wherein said lateral flanges, side segments, base segment and beads are formed from a one-piece wire mesh construction.

* * * * *